US011193731B2

(12) United States Patent
Shearer et al.

(10) Patent No.: US 11,193,731 B2
(45) Date of Patent: Dec. 7, 2021

(54) ACTIVE CARRY HOLSTER ASSEMBLY

(71) Applicant: Tedder Industries, LLC, Post Falls, ID (US)

(72) Inventors: Jacob Shearer, Moses Lake, WA (US); Taylor Vold, Spokane Valley, WA (US)

( * ) Notice: Subject to any disclaimer, the term of this patent is extended or adjusted under 35 U.S.C. 154(b) by 0 days.

(21) Appl. No.: 16/927,851

(22) Filed: Jul. 13, 2020

(65) Prior Publication Data

US 2021/0025672 A1 Jan. 28, 2021

Related U.S. Application Data

(60) Provisional application No. 62/878,633, filed on Jul. 25, 2019.

(51) Int. Cl.
*F41C 33/04* (2006.01)
*F41C 33/02* (2006.01)

(52) U.S. Cl.
CPC ..... *F41C 33/041* (2013.01); *F41C 33/046* (2013.01); *F41C 33/0245* (2013.01)

(58) Field of Classification Search
CPC .. F41C 33/041; F41C 33/046; F41C 33/0245; F41C 33/00; F41C 33/001; F41C 33/002; F41C 33/006; A45F 5/021; A45F 2200/0591; A45F 2200/0575; A41F 9/00
See application file for complete search history.

(56) References Cited

U.S. PATENT DOCUMENTS

| | | | | |
|---|---|---|---|---|
| 9,593,915 | B2 * | 3/2017 | Tuggle | F41C 33/0209 |
| 2004/0226972 | A1 * | 11/2004 | Cook | A45F 5/021 224/195 |
| 2017/0051999 | A1 * | 2/2017 | Tedder | F41C 33/041 |
| 2017/0181508 | A1 * | 6/2017 | Pemberton | A41F 9/002 |
| 2017/0254617 | A1 * | 9/2017 | Noble | F41C 33/041 |
| 2018/0020755 | A1 * | 1/2018 | Tedder | A41F 9/002 2/322 |
| 2020/0077776 | A1 * | 3/2020 | Hawkins | A45F 5/021 |
| 2021/0137252 | A1 * | 5/2021 | Knudsen | F41C 33/046 |

* cited by examiner

*Primary Examiner* — Corey N Skurdal
(74) *Attorney, Agent, or Firm* — Chang and Hale LLP

(57) ABSTRACT

Representative implementations of devices and techniques provide a belt for an implement holster comprising multiple stacked layers, including reinforcement layers enclosed within outer layers of the belt. The construction of the belt allows the belt to be worn with garments that do not necessarily include belt loops, such as active wear and women's formal wear. An implement holster may be coupled to the belt, using one or more clip loops, to form an active carry holster assembly.

20 Claims, 6 Drawing Sheets

ACTIVE CARRY HOLSTER ASSEMBLY

PRIORITY CLAIM AND CROSS-REFERENCE TO RELATED APPLICATION

This application claims the benefit under 35 U.S.C. § 119(e)(1) of U.S. Provisional Application No. 62/878,633, filed Jul. 25, 2019, which is hereby incorporated by reference in its entirety.

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished. In some cases, such as with a handgun for example, the holster may allow the user to conceal the implement, or to conceal the fact that the user is carrying the implement.

In some situations, the user may desire to carry the implement while wearing clothing that doesn't always lend itself to the use of a belt, such as athletic or leisure type clothing, a skirt or dress, or like apparel. In these situations, the user may desire to carry the implement at or near the waistband of the clothing for easy access to the implement, to conceal the implement, or for other reasons. In these and other situations, the user may also desire to have concealed pockets or pouches for holding money, keys, valuables, accessories, or the like.

In many cases, the athletic or leisure type clothing, skirt, or dress worn by the user may not provide sufficient rigidity or stability to support a holster or an implement, nor sufficient or secure enough pockets to hold valuables and so forth. Further, the weight of an implement or a holster may pull on the clothing, causing the clothing to sag or to move to an undesired position.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Introduction

Figure 1:
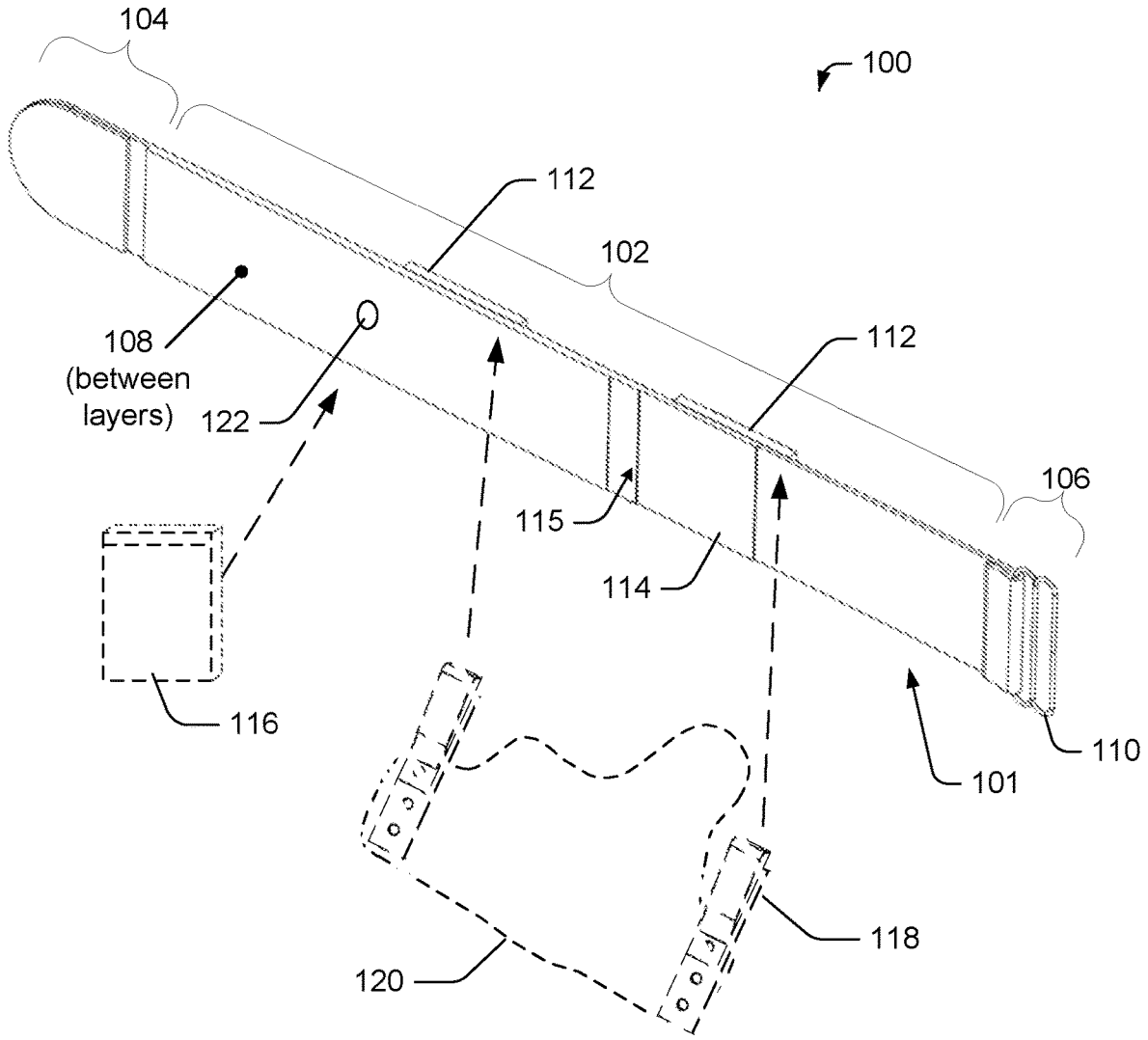
FIG. 1 is a perspective view from a first side of an example belt for an active carry holster assembly, according to an embodiment.

Representative implementations of devices and techniques provide an active carry holster assembly ("assembly"), which includes an example holster for carrying a weapon, tool, or other implement, as well as an active carry belt ("belt") that may be used as a standalone device or as part of the assembly. The assembly includes one or more attachment devices that may be used to temporarily or permanently attach one or more interchangeable holster components (i.e., holsters, holster backers, etc.) for carrying an implement. In an example, the attachment devices may removably attach an interchangeable holster component to the belt, which can be exchanged with another holster component by the user as desired.

In various implementations, the belt, which may be worn by the user as an alternative to a traditional belt, may be comprised of a single layer or multiple layers. The multiple layers may be selected to provide various desired characteristics for the belt, such as strength, comfort, resilience, utility, weight, and so forth. For instance, outer layers may provide comfort and durability while layers between the outer layers may provide strength and rigidity. In many examples, all layers may contribute to desired light weight, strength, and resilience.

In some implementations, the belt includes one or more reinforcement layers comprising a metal, a metal alloy, a metallic composite, other composite(s), ballistic nylon, or the like. For instance, in some implementations the reinforcement layers may include a metal or metallic layer and one or more other layers, including other metallic layers, composite layers, ballistic nylon layers, or the like. In the implementations, the reinforcement layer or layers provides rigidity while allowing the belt to conform to the user's body. For example, the reinforcement layer(s) prevents the belt from deforming, thus giving the belt the capability to carry heavy loads without sagging.

In an implementation, the belt includes an adjustment portion coupled to one end of the belt to provide retention of the belt to the user. In the implementation, the adjustment portion can interface with a belt fastener of a closure portion at another end of the belt. The adjustment portion and the closure portion temporarily couple together the ends of the belt when the belt is wrapped around the user. In one example, the adjustment portion comprises hook and loop fasteners, or the like. In the example, the adjustment portion may be inserted through an opening in the belt fastener, and looped back on itself or on the belt, temporarily coupling the adjustment portion to the other end of the belt.

This is advantageous when the user is wearing clothing (such as many types of athletic or leisure clothing) that has no belt loops or that would not be able to support the weight of the holster and implement. The adjustment portion allows the belt to be retained on the body of the user, rather than relying on the user's clothing for support.

In another implementation, the belt may include a tension portion. For example, the tension portion can at least partially flex when the belt is wrapped around the user, to provide additional retention of the belt to the user. In an implementation, the tension portion may be located within a gap formed in one or more layers of the belt. In other implementations, one or more layers of the belt may be flexible, comprising the tension portion for the belt.

Techniques and devices are discussed with reference to example handgun belts and holsters illustrated in the figures. However, this is not intended to be limiting, and is for ease of discussion and illustrative convenience. The techniques and devices discussed may be applied to a belt arranged to be coupled to any of various cases, case designs, combinations, and the like, (e.g., holsters, sheaths, covers, cases, carriers, scabbards, etc.) for encasing tools, weapons, or other implements, and remain within the scope of the disclosure.

Further, the techniques and devices are discussed and illustrated generally with reference to a concealed carry style holster. This is also not intended to be limiting. In various implementations, the techniques and devices may be employed with inside waistband (IWB) holsters, outside waistband (OWB) holsters as well as holsters that may be worn in various ways using a belt. In alternate implementations, the techniques and devices may be employed in other ways or with other devices, systems, instruments, or the like.

Implementations are explained in more detail below using a plurality of examples. Although various implementations and examples are discussed here and below, further implementations and examples may be possible by combining the features and elements of individual implementations and examples.

Example Active Carry Holster Assembly

Figure 2:
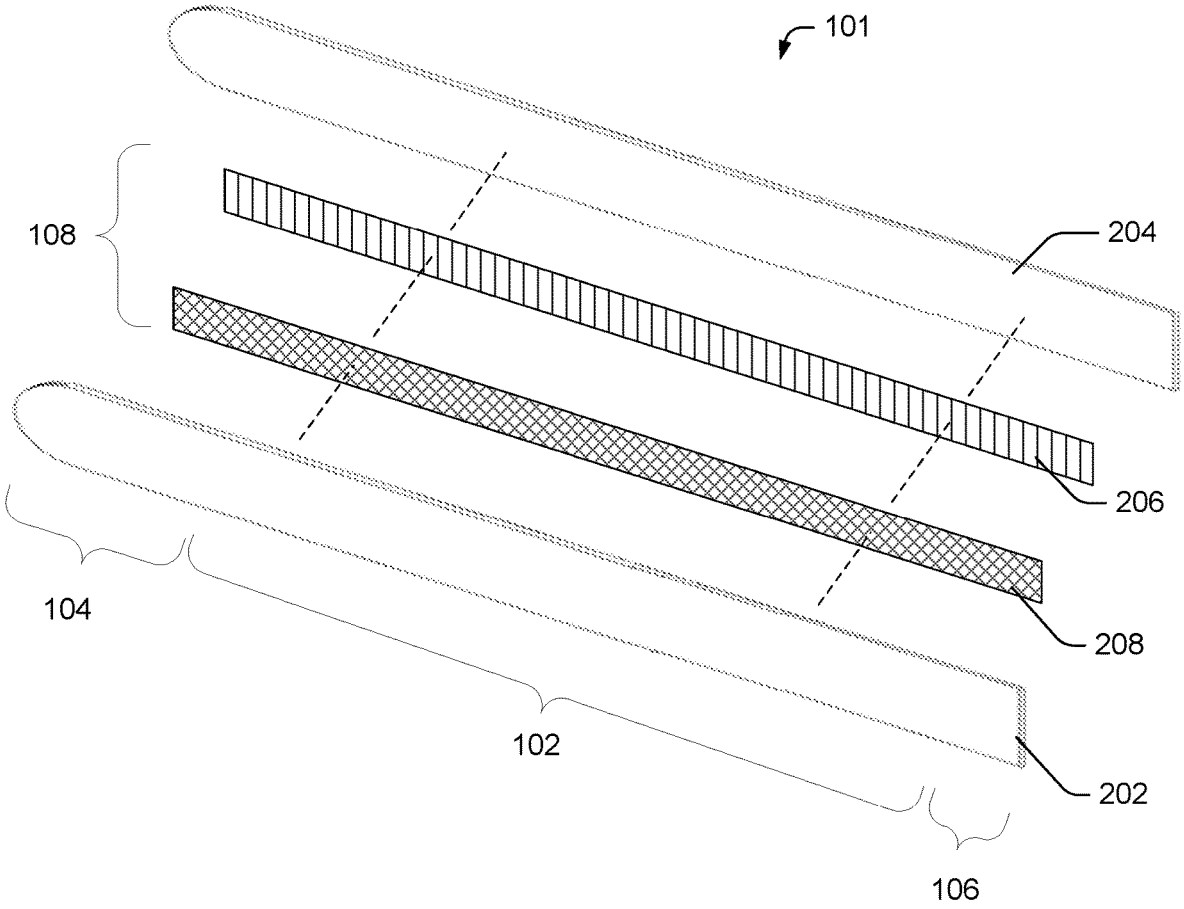
FIG. 2 is an exploded view of an example belt for an active carry holster assembly, according to an embodiment.

Referring to FIGS. 1 through 7, an example active carry holster assembly ("assembly") 100 is shown and described in several non-limiting example configurations. In various embodiments, an assembly 100 includes an active carry belt 101, comprised of a belt portion 102, an adjustment portion 104, and a closure portion 106. In various implementations, as shown at FIG. 2, the belt 101 may be comprised of multiple stacked layers, and may also include a reinforcement portion 108 disposed between layers of the belt 101. In alternate embodiments, the belt 101 may include additional or alternate components or features.

In the embodiments, the assembly 100 may also include a belt fastener 110, one or more attachment devices 112 (such as clip loops, for example) and one or more security pockets 114. In some examples, the assembly 100 may also include one or more accessory pouches 116, or the like, that may be integral to the assembly 100 or may be removable.

In an example, as shown at FIG. 1, the attachment devices 112 can temporarily or permanently couple one or more implement holster components 118 (such as hooks, clips, snap-type fasteners, screw and nut fasteners, or the like) to the belt 101. Attachment devices 112 can include loops, pockets, openings, and so forth. Other holster components that may be attached to the belt 101 via the attachment devices 112 can include paddles, slides, or like components.

Using the attachment devices 112, a variety of different types, designs, and arrangements of holsters 120 (including holster backers, and so forth) can be coupled to the belt 101 as desired by the user. In some implementations, the assembly 100 includes the holster components 118 (e.g., mount clips) and/or the holster 120. In some examples the holster components 118 and the holster 120 may be permanently fastened to the belt 101, and in other examples the holster components 118 and/or the holster 120 may be removable. In some implementations, the holster component(s) 118 may be an option on the belt 101, and in other implementations, the belt 101 and the holster component(s) 118 may be combined as a single system, for example.

In an implementation, the belt 101 is wrapped around the body of a user. For instance, the belt 101 may be wrapped around the midsection of the body of the user when the belt 101 or assembly 100 is worn by the user (e.g., when the belt 101 is worn at the waist, trunk, torso, etc. of the user). The adjustment portion 104 is interfaced with the closure portion 106 to couple the ends of the belt 101, securing the belt 101 to the user. In other examples, the belt 101 may be wrapped around another body portion of the user (e.g., around the hips, across the chest and/or shoulder, etc.) as desired, and the belt 101 secured in like manner.

In the various applications, at least a portion of the belt 101 is worn snugly around a user's trunk, so as to conform to the user's body. This allows a user to wear additional clothing over the belt 101, concealing the belt 101 and any holstered implements from view, while maintaining a natural appearance.

In various implementations, as shown at FIG. 2, the belt 101 may be comprised of multiple parallel stacked layers (e.g., layers 202, 204). For example, the belt 101 may be comprised of two or more parallel strips coupled together (e.g., with adhesive, stitching, fasteners, etc. or a combination of the same) in an aligned stack. (For instance, one layer of a belt 101 having three or more layers can comprise an adhesive layer, extending partially or the full length of the belt 101.)

In the implementations, the belt 101 includes at least two parallel outer layers: an outside layer 202 and an inside layer 204, with a substantial portion, if not all of their respective profiles aligned together. The outside layer 202 is disposed to be on the outside of the belt 101, away from the user when the belt is worn around the body of a user. The inside layer 204 is disposed to be on the inside of the belt 101, toward or against the user when the belt is worn around the body of a user.

In one implementation, the multiple layers (including layers 202 and 204) comprise at least two different materials. In an example, the belt 101 may include one or more layers between the outside layer 202 and the inside layer 204, or none. In an embodiment, one or both layers of the multiple layers (including layers 202, 204) comprises a substantially non-elastic material (e.g., a nylon material, a para-aramid or aramid material, a fiberglass material, a carbon fiber material, a metallic material, an animal hide, synthetic leather, or the like).

In one implementation, the outside layer 202 and the inside layer 204 are comprised of different materials. For example, the inside layer 204 may be comprised of a resilient material that is more comfortable to be worn against skin. In contrast, middle layer(s) or the outside layer 202 may be comprised of a material that is highly durable, without as much consideration to comfort. In one example, the outside layer 202 is comprised of a robust nylon material (e.g., ballistic nylon), or the like, and the inside layer 204 is comprised of a more comfortable, yet resilient, neoprene material (or the like).

In some cases, stiffening elements such as rigid or semi-rigid components (e.g., plastics, fibers, etc.) may be inserted within the belt 101 to make the belt 101 more rigid. The stiffening elements may be inserted within or between layers of material (e.g., 202 and 204) of the belt 101, may be glued in, sewn in, or otherwise coupled into the belt 101, within the layers of material or on the outside or inside surface of one of the layers of material (e.g., 202 and 204). In some cases, the stiffening elements may be formed with contours intended to conform to the shape of the user's body.

For example, in an implementation, the belt 100 includes a reinforcement portion 108 disposed between (i.e., sandwiched between) at least two layers (e.g., 202 and 204) of the belt 101, and enclosed by the outside (202) and inside (204) layers. In some embodiments, the reinforcement portion 108 is comprised of one or more layers (e.g., layers 206 and 208) of a metal, a metal alloy, a metallic composite, another composite, a ballistic nylon, a polymer, combinations of the same, or the like. In the implementation, the reinforcement portion 108 provides rigidity and stability to the belt 101.

In various embodiments, the reinforcement portion 108 may have various configurations and arrangements, and may be comprised of one or more layers (e.g., layers 206 and 208) of various materials to provide the desired rigidity and stability, according to various applications. A plurality of reinforcing layers (e.g., layers 206 and 208) may all be disposed between one set of layers (e.g., between layers 202 and 204) of the belt 101, or the plurality of reinforcing layers may be dispersed between different layers of the belt 101 (e.g., when the belt 101 includes more than 2 layers).

In some embodiments, the reinforcement portion 108 is comprised of multiple layers (e.g., layers 206 and 208), where the plurality of reinforcing layers comprise different materials or the same material. In some implementations, the reinforcement portion 108 comprises at least one metallic layer and one or more other layers. For example, the one or more other layers may include metallic layers, composite layers, ballistic nylon layers, or the like. For example, in one embodiment, at least one layer (e.g., layers 206 and/or 208) of the reinforcement portion 108 comprises a spring steel layer, a titanium layer, or the like. For instance, the reinforcement portion 108 may include a layer of steel and a layer of titanium, or it may include a layer of titanium and a layer of polycarbonate, and so forth.

In another example, a ballistic nylon layer may be included within the reinforcement portion 108 to provide additional durability and rigidity to the belt 101. The ballistic nylon layer can also add comfort, protection, and padding between the user and the metallic layer. The term "ballistic nylon" can include any of various nylon weaved textiles of various denier (such as 840, 1050, and 1680 denier) and various weave patterns, that resist abrasion, tearing, and wear. In the embodiments, the selection and placement of the materials can result in the desired rigidity characteristics for the belt 101. Alternately, the material of each layer (e.g., layers 206 and 208) of the reinforcement portion 108 may be the same.

In some implementations, the thickness and the width of the layers (e.g., layers 206 and 208) of the reinforcement portion 108 is consistent along the length of the reinforcement portion 108. For instance, in one embodiment, a layer of the reinforcement portion 108 is 0.010" thick. In other cases, the layers may be thicker or thinner. However, in some embodiments, the thickness and/or the width of the layers of the reinforcement portion 108 varies along the length of the reinforcement portion 108, according to a predetermined pattern or scheme. In the embodiments, the variation of thickness and/or width determines the rigidity or the flexibility of the reinforcement portion 108 according to the predetermined pattern or scheme. For example, the reinforcement portion 108 may be more narrow and/or be thinner (lighter gauge) at an area of the belt 101 where more flexibility is desired, and may be more wide and/or be thicker (heavier gauge) at an area of the belt 101 where more rigidity is desired.

In various embodiments, one or more reinforcement layers (e.g., layers 206 and 208) of the reinforcement portion 108 extend the full length of the belt 101. In an example, one or more layers (e.g., layers 206 and 208) of the reinforcement portion 108 extends fully along a length of the belt 101 through the closure portion 106 and/or the adjustment portion 104. In another example, the layer(s) of the reinforcement portion 108 extend somewhat into the closure portion 106 and/or the adjustment portion 104. In the examples, the material of the layers (e.g., layers 206 and 208) of the reinforcement portion 108 may vary from portion to portion (102, 104, and 106) of the belt 101.

In another embodiment, the layers (e.g., layers 206 and 208) of the reinforcement portion 108 extend a partial length (or multiple partial lengths) of the belt 101. In the embodiment, the partial length(s) of the layers (e.g., layers 206 and 208) of the reinforcement portion 108 are arranged to provide reinforcement at one or more predetermined areas of the belt 101 where additional stability or rigidity is desired. For instance, in one embodiment, the reinforcement portion 108 comprises multiple segments of one or more layers 206 and/or 208, disposed between at least two layers (e.g., layers 202 and 204) of the belt 101.

In an implementation, a tension portion (not shown) is coupled to the belt 101 and is arranged to at least partially flex, so as to be under tension when the belt 101 is wrapped around the user. In the implementation, the tension portion provides retention of the belt 101 to the user through the flexing. For example, when wearing the belt 101, the user may pull the belt 101 tight around the user's body, at least partially flexing (e.g., stretching) the tension portion, and couple the ends of the belt 101 with the tension portion under tension. Doing so can increase the grip or retention of the belt 101 on the user.

In one implementation, the tension portion is located within a gap in one or more layers of the belt 101, bridging the gap in the one or more layers of the belt 101. In various examples, the gap is either a partial or a complete separation between portions of the belt 101. In another implementation, an inside layer 204 of the belt 101 may comprise the tension portion. For instance, the inside layer 204 may be comprised of a flexible or semi-flexible material (e.g., spandex, rubber, synthetic rubber, or the like). In alternate implementations, one or more middle layers (if present) may comprise a flexible or semi-flexible material, comprising a tension portion.

Referring to FIG. 1, in an implementation, the adjustment portion 104 is disposed at a first end of the belt 101, and is arranged to interface with the closure portion 106 to couple the ends of the belt 101. In various embodiments, the adjustment portion 104 may include various functional features (e.g., belt holes, hook and loop fastener, snaps, etc.) for interfacing with the closure portion 106 in an adjustable manner to couple the ends of the belt 101.

In one example, the adjustment portion 104 includes hook and loop fastener material, or the like, on one or more surfaces. For instance, in an example, a first part of the adjustment portion 104 comprises either a hook material or a loop material and a second part of the adjustment portion 104 comprises the other of the hook material or the loop material. Contacting the first part to the second part secures the belt 101 on the user in the desired position with the desired tightness when the closure portion 106 is interfaced with the adjustment portion 104. In the example, the first part of the adjustment portion 104 may be inserted through an opening in the belt fastener 110, and looped back on itself or on the belt 101, temporarily coupling the adjustment portion 104 back onto the belt 101.

In various embodiments, as shown at FIG. 2, the adjustment portion 104 may be comprised of two or more layers. In some embodiments, the layers (202, 204) of the belt 101 extend continuously through the adjustment portion 104. In one embodiment, the reinforcement portion 108 extends partially or fully through the adjustment portion 104. In one example, one or more metallic layers are disposed between the layers of the adjustment portion 104, while allowing the adjustment portion 104 to bend or articulate with respect to the closure portion 106.

In an implementation, the closure portion 106 is coupled to at least one end of the belt 101 to temporarily couple together the ends of the belt 101 when the belt 101 is wrapped around the user. For instance, in various examples, the closure portion 106 may be coupled to one end of the belt and the adjustment portion 104 may be coupled to the other end of the belt 101. In the example, the closure portion 106, which includes the belt fastener 110, interfaces with the adjustment portion 104 (e.g., the adjustment portion 104 may be threaded through an opening in the belt fastener 110 and looped back on itself or on the belt 101). In an implementation, as shown in FIG. 1, the belt fastener 110 may include a D-ring, a loop, a double-ring, a buckle, or the like.

The user adjusts the tension of the belt 101 while wrapping the belt 101 around the user by pulling on the ends of the belt 101 (which may include flexing (i.e., stretching) the tension portion if included), and then coupling the adjustment portion 104 to the closure portion 106 while the belt 101 is under the desired tension. This can determine a retention of the belt 101 on the user, and can allow the user to conceal the assembly 100 (including the implement holster 120) beneath the user's clothing if desired.

In alternate embodiments, the closure portion 106 and/or the adjustment portion 104 may include snaps, buttons, hooks, or other fasteners, and so forth, to couple the belt 101 together. The examples shown in FIGS. 1-6 and described herein are not intended to be limiting. In alternate implementations, the closure portion 106 may have other arrangements or configurations, and may be used with additional closure components to temporarily couple together the ends of the belt 101 when the belt 101 is wrapped around the user.

Figure 3:
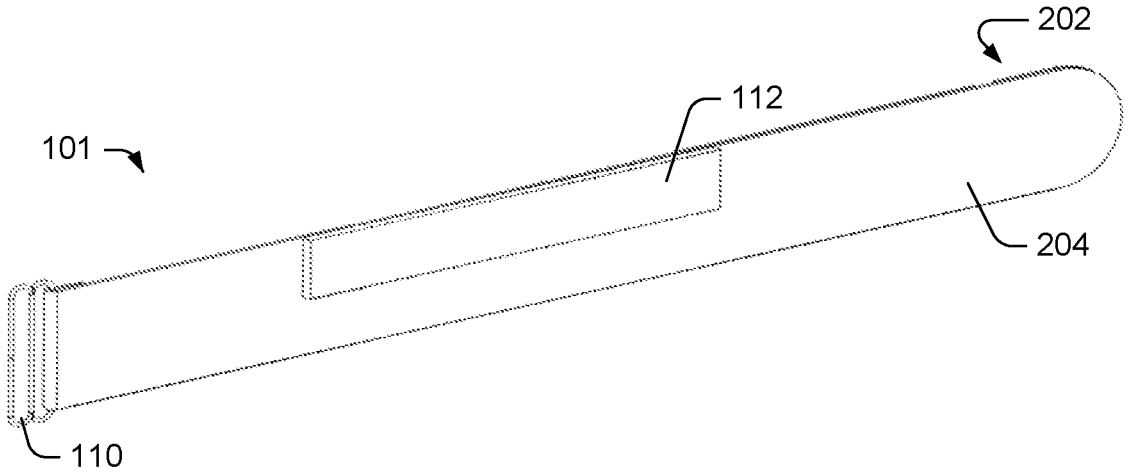
FIGS. 3 and 4 are perspective views from a second side of an example belt for an active carry holster assembly, according to various embodiments.
Figure 4:
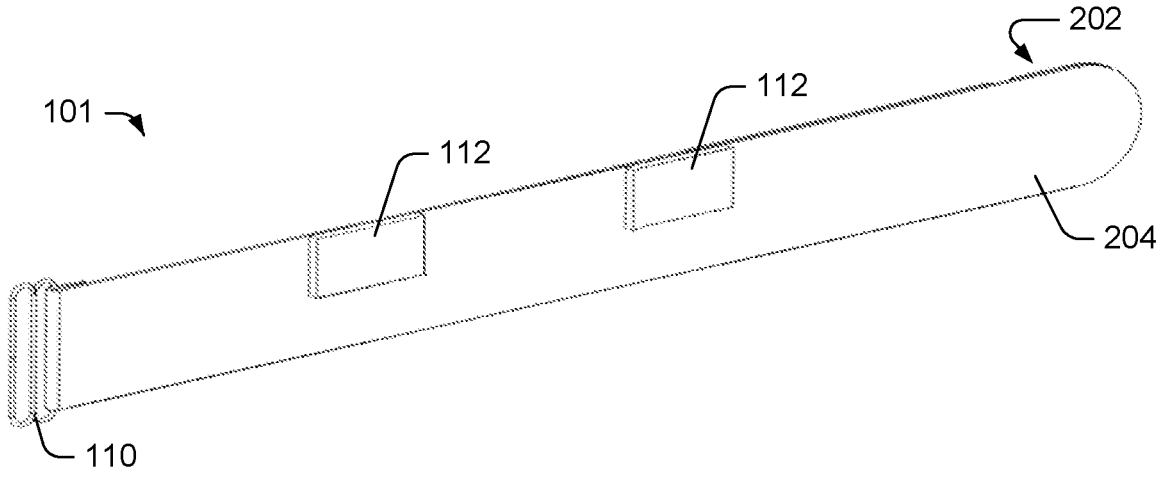

In various implementations, as shown at FIGS. 3 and 4, one or more clip loops 112 are coupled to the belt 101 or are integral to the belt 101. The one or more clip loops 112 are used to permanently or releasably couple an implement holster component 118 (such as a mount clip) to the belt 101. In some examples, one or two clip loops 112 are coupled to or fixed to the belt 101, for instance to a surface of the inside layer 204 of the belt 101. Alternately, clip loops 112 may be coupled to a surface of the inside layer 204 and a surface of the outside layer 202 of the belt 101.

In one implementation, several clip loops 112 may be arranged (e.g., permanently or removably coupled) along the length of the belt 101. This can provide multiple attachment locations to couple an implement holster 120 to the belt 101, as desired by the user. In various examples, one or more of the mounting locations (clip loops 112) may be used to attach other components to the belt 101 (such as an accessory, an accessory pouch, or the like).

In various embodiments, the clip loops 112 may comprise one or more layers of similar or dissimilar materials, including textiles, natural or synthetic leathers, aramids, composites, plastics, metallic materials, and so forth. For instance, the clip loops 112 may include reinforced material loops or lengths of material strips that are fastened to the belt 101 along edges of the material strips, forming pockets or loops on the belt 101 that are accessible to holster mount components 118 (such as mount clips as shown at FIG. 1).

Figure 5:
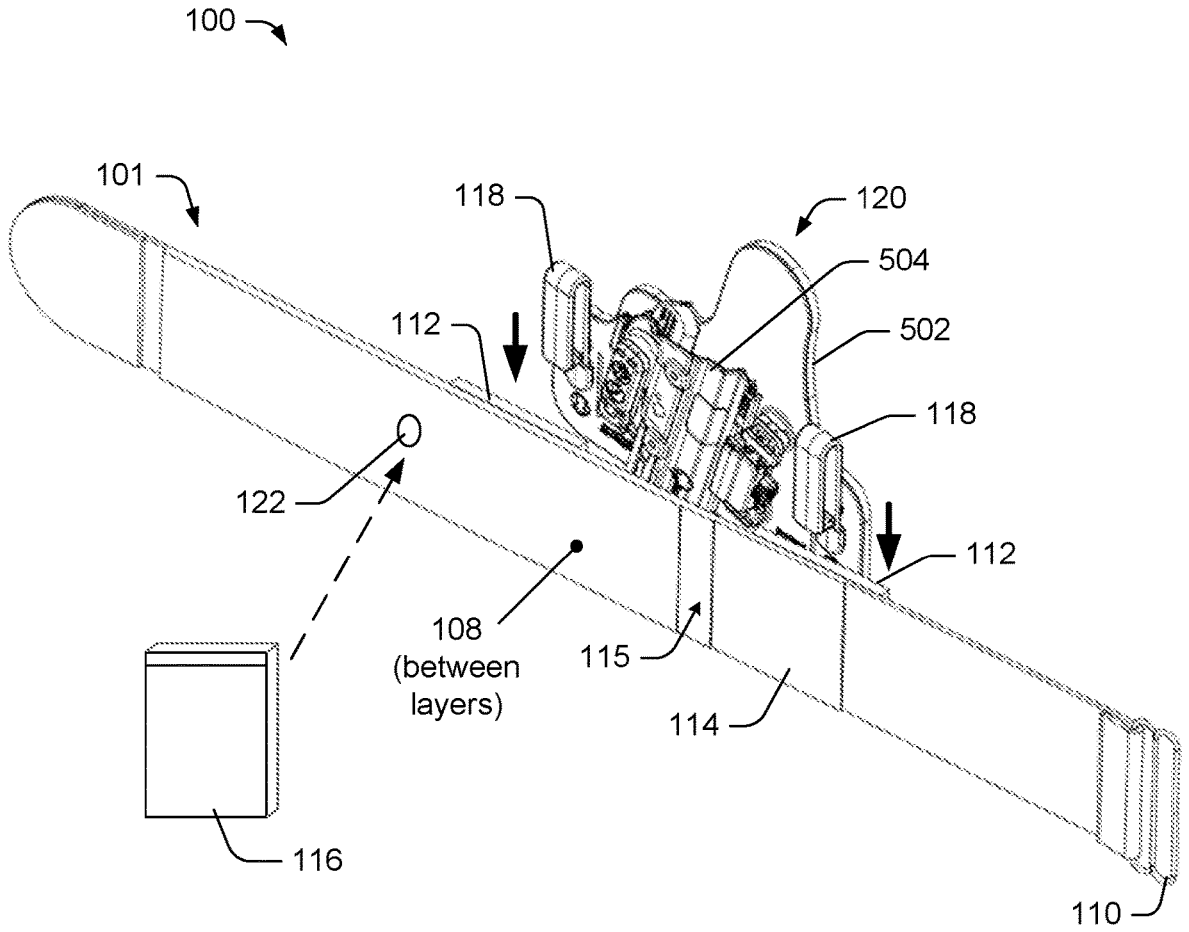
FIG. 5 is a perspective view from a first side of an example active carry holster assembly, according to an embodiment.
Figure 6:
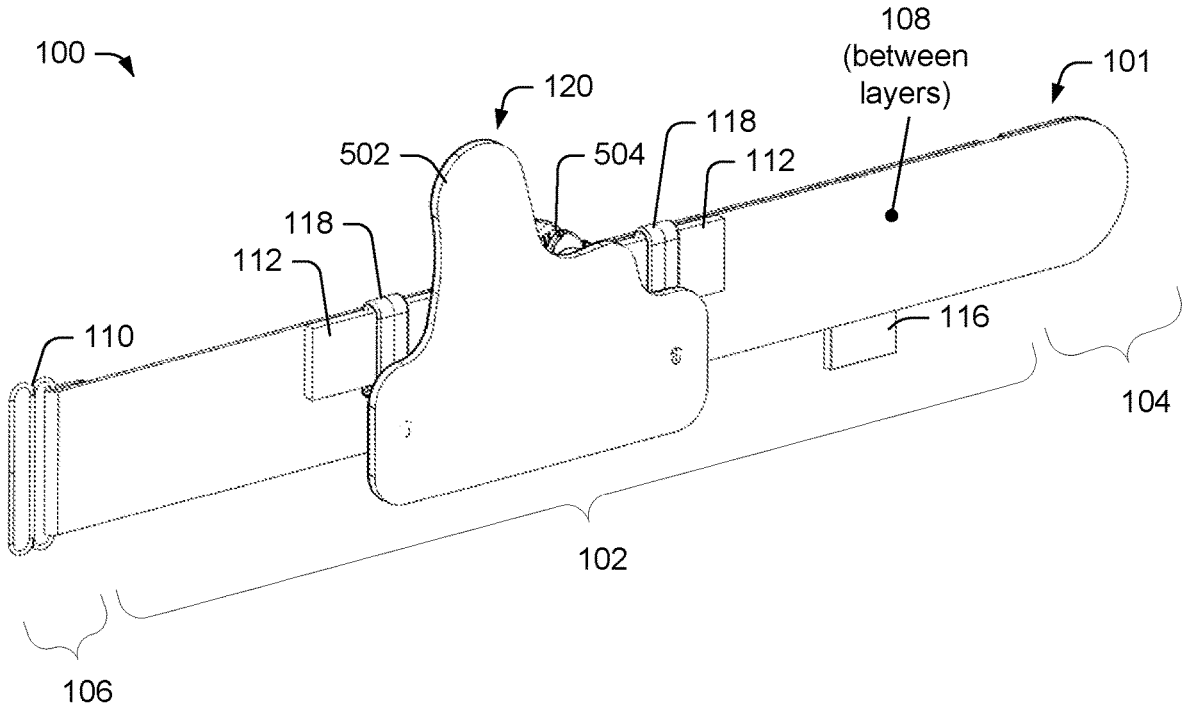
FIG. 6 is a perspective view from a second side of an example active carry holster assembly, according to an embodiment.

As shown at FIGS. 5 and 6, the mount components 118 may be inserted into the pockets or loops (the clip loops 112) to attach a holster 120 (or holster backer) to the belt 101. Alternately, mount components 118 may be used (i.e., inserted into the clip loops 112) to attach an accessory, an accessory pouch, or other component to the belt 101.

In some cases, the clip loops 112 comprise molded plastic pockets or loops shaped and sized to snugly fit one or more types of mount clips, paddles, slides, and so forth. The molded pockets or loops may include features (such as ridges, recesses, openings, etc. to help trap the clips, paddles, slides, etc. Alternately, the clip loops 112 may include a combination of layers of textiles, natural or synthetic leathers, aramids, composites, plastics, metallic materials, and so forth.

Referring to FIGS. 5 and 6, in some examples, the assembly 100 can be modular, allowing for a variety of implements to be carried as desired. In one implementation, the clip loops 112 couple a holster component such as a holster backer 502, for example, to the belt 101. In the implementation, a holster backer 502 may include one or more releasable fasteners to removeably couple one of a multiplicity of holster covers 504 to the holster backer 502 in a modular fashion. In the implementation, the modular covers 504 augment the holster backer 502 as desired, to carry a multiplicity of different implements with the assembly 100. In various implementations, the releasable fasteners may include snap-type fasteners, screw and nut fasteners, or other types of fasteners.

In another implementation, a unit holster 120, such as an inside-the-waistband (IWB) holster for example, is removably or permanently attached by its included belt clips 118 onto the belt 101 via one or more of the clip loops 112. For instance, the belt clips 118 may be inserted through an opening in the clip loops 112, clipping to the material(s) of the clip loops 112. Additionally, other accessories having a clip (e.g., a pocket knife, a flashlight, a pepper spray canister, etc.) or having a case with a clip may be attached to the belt 101 using the clip loops 112.

In an embodiment, the belt 101 includes one or more integrated security pockets 114. A security pocket 114 may be formed using the multiple layers of the belt 101, with an opening 115 in one or more of the outer layers (e.g., layers 202 and 204) of the belt 101, accessing an area within (e.g., between) the layers. In some cases, a pocket or pouch may be inserted between layers (e.g., layers 202 and 204) of the belt 101, which may be accessed through an opening 115 in one or more of the layers of the belt 101. Alternately, a security pocket 114 may be formed by attaching one or more portions of material to an exposed surface of the belt 101.

A security pocket 114 may be located on an inside surface and/or an outside surface of the belt 101. In some cases, the security pocket 114 is large enough to hold the user's I.D., credit cards, cash, keys, or the like, and may be sealable with a zipper, zip-lock, hook and loop closure, magnet, snap, or with various fasteners.

In some embodiments, one or more accessory pouches 116 may be included with the assembly 100. Accessory pouches 116 may be sized and configured to hold a cell phone, a wallet, extra ammunition magazines, and so forth. In various embodiments, accessory pouches 116 may be formed of various textiles, polymers, composites, metals, and combinations of these. Accessory pouches 116 may include some form of closure (e.g., zipper, zip-lock, hook and loop, magnet, snaps, other fasteners) to retain or to protect the contents of the pouch 116. Accessory pouches 116 may be water proof or water resistant in some cases. Some accessory pouches 116 may be fixed to the belt 101 and others may be removably attached to the belt 101.

In various embodiments, accessory pouches 116 may be removably coupled to the belt 101 using the clip loops 112 on the belt 101. For instance, the pouches 116 may include clips or closeable loops that interface with the clip loops 112, holding the pouch 116 to the clip loops 112. In other embodiments, the accessory pouches 116 may be removably coupled to the belt 101 with the use of a coupler 122, which may comprise one or more removable fasteners (e.g., snaps, hook and loop fasteners, clips, etc.). Couplers 122 may be positioned at various locations on an inside surface or an outside surface of the belt 101. Alternately, some accessory pouches 116 may include support loops that the belt 101 can slide through.

In alternate implementations, the assembly 100 may include additional loops, straps, hooks, clips, or the like, to attach one or more accessories. For instance, a loop or clip, etc. may be disposed within a pocket 114 to secure a key, for example. In another example, a loop or clip, etc. may be attached to an outer surface or edge of the belt 101 to attach an ID card, badge, penlight, or other accessory.

As discussed above, the techniques, components, and devices described herein with respect to the implementations are not limited to the illustrations of FIGS. 1-7, and may be applied to other belts, holster components and devices, and case designs, without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results.

It is to be understood that an active carry holster assembly 100 may be implemented as a stand-alone device or as part of a system (e.g., integrated with other components). In various implementations, additional or alternative components may be used to accomplish the disclosed techniques and arrangements.

In the various example embodiments illustrated in FIGS. 1-6, the location and position of the clip loops 112, pockets 114, openings 115, pouch 116, holster 120, and the like are for example. Other locations and positions are contemplated and are within the scope of this disclosure. In various implementations, the assembly 100 may include fewer, more, or alternate components, and remain within the scope of the disclosure.

Various implementations and examples are discussed herein, and further implementations and examples may be possible by combining the features and elements of individual implementations and examples.

Representative Process

Figure 7:
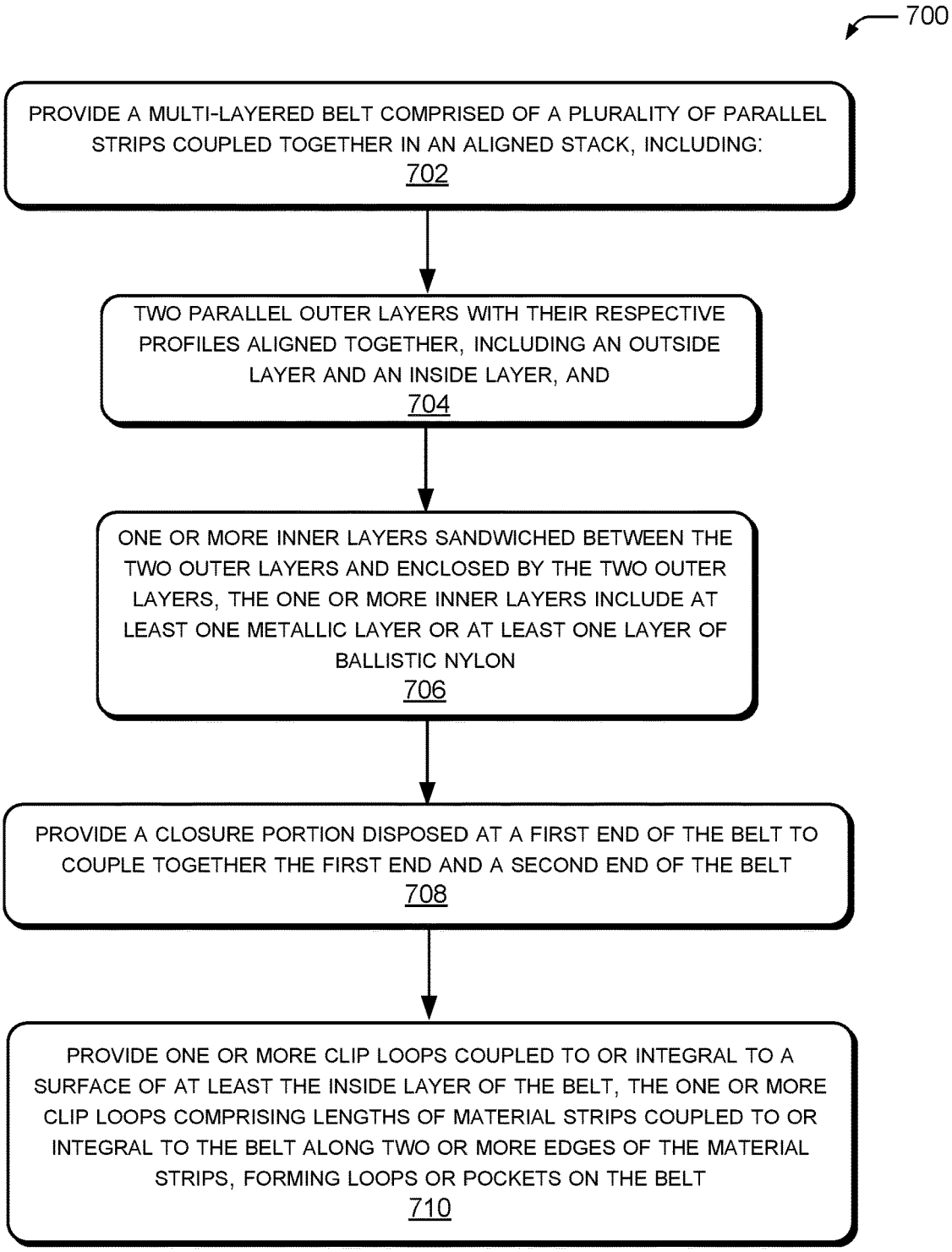
FIG. 7 illustrates a flow diagram of a method of forming an example active carry holster assembly, according to an implementation.

FIG. 7 is a flow diagram illustrating an example method 700 for providing an active carry holster assembly (such as assembly 100, for example), including an active carry reinforced belt (such as belt 101, for example), according to various implementations. The process 700 is described with reference to FIGS. 1-6.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 702, the process includes forming a multi-layered belt (such as belt 101, for example) of a plurality of parallel strips coupled together in an aligned stack. In various embodiments, the belt may be formed of animal hides, synthetic materials, textiles, composite materials, or the like.

At block 704, the process includes forming the multi-layered belt to include two parallel outer layers with their respective profiles aligned together, including an outside layer (such as layer 202, for example) and an inside layer (such as layer 204, for example). The respective profiles of the outside layer and the inside layer have the same shape (or nearly the same shape), and are aligned in a stack.

At block 706, the process includes forming the multi-layered belt to include one or more inner layers (such as layers 206 and 208, for example) sandwiched between the two outer layers and enclosed by the two outer layers. In an implementation, the one or more inner layers includes at least one metallic layer or at least one layer of ballistic nylon. The one or more inner layers comprise a reinforcement portion of the belt (such as reinforcement portion 108, for example). For instance, a layer of the reinforcement portion may be formed of a spring steel layer, a titanium layer, a ballistic nylon layer, or the like.

In some embodiments, the process includes forming the reinforcement portion of a plurality of layers, such as a plurality of metallic layers or a plurality of layers of other materials. The multiple layers may each comprise the same material or may comprise different materials as desired for strength and flexibility. In an implementation, the process includes extending the reinforcement portion a length of the belt portion. In other embodiments, the reinforcement portion extends one or more partial lengths of the belt portion.

In another implementation, the process includes varying a thickness or a width of the layers of the reinforcement portion along a length of the reinforcement portion according to a predetermined pattern. The rigidity or the flexibility of the belt is determined according to the predetermined pattern.

At block 708, the process includes providing a closure portion disposed at a first end of the belt arranged to couple together the first end and a second end of the belt. In an embodiment, the process includes providing an adjustment portion disposed at the second end of the belt to interface with the closure portion to determine a retention of the belt when the first end and the second end of the belt are coupled together.

At block 710, the process includes providing one or more clip loops coupled to or integral to a surface of at least the inside layer of the belt. In an implementation, the one or more clip loops comprise lengths of material strips coupled to or integral to the belt along two or more edges of the material strips, forming loops or pockets on the belt. In an embodiment, the process includes providing an implement holster removably coupled to the belt via the one or more clip loops. In an example, the implement holster is mounted to the belt using one or more mount devices coupled to the implement holster and inserted into one or more of the clip loops. In some embodiments, the implement holster is a handgun holster. In other embodiments, the implement holster is a case or sheath for a tool, weapon, accessory, and the like.

In an embodiment, the process includes providing a security pocket formed within the belt, between the two parallel outer layers, and an opening to access the security pocket through at least one of the two parallel outer layers.

In alternate implementations, other techniques may be included in the process 700 in various combinations, and remain within the scope of the disclosure.

CONCLUSION

While various discreet embodiments have been described throughout, the individual features of the various embodiments may be combined to form other embodiments not specifically described. The embodiments formed by combining the features of described embodiments are also within the scope of the disclosure.

What is claimed is:

1. An apparatus, comprising:

a multi-layered belt comprising a plurality of parallel strips coupled together in an aligned stack, including:

two parallel outer layers with their respective profiles aligned together, including an outside layer and an inside layer; and one or more inner layers sandwiched between the two outer layers and enclosed by the two outer layers, wherein the one or more inner layers includes at least one metallic layer or at least one layer of ballistic nylon;

a closure portion disposed at a first end of the belt arranged to couple together the first end and a second end of the belt; and one or more clip loops coupled to or integral to a surface of at least the inside layer of the belt to couple an implement or an implement holster to the belt, the one or more clip loops comprising lengths of material strips coupled to or integral to the belt along two or more edges of the material strips, which form loops or pockets on the belt.

2. The apparatus of claim 1, further comprising a security pocket formed within the belt, between the two parallel outer layers, and an opening to access the security pocket through at least one of the two parallel outer layers.

3. The apparatus of claim 1, further comprising one or more accessory pouches integral to or coupled to the belt.

4. The apparatus of claim 3, wherein at least one of the one or more accessory pouches is removably coupled to the belt.

5. The apparatus of claim 1, further comprising a tension portion integral to the belt and arranged to at least partially stretch when the belt is wrapped around a user, to provide retention of the belt.

6. The apparatus of claim 1, further comprising an adjustment portion disposed at the second end of the belt and arranged to interface with the closure portion to determine a retention of the belt when the first end and the second end of the belt are coupled together.

7. The apparatus of claim 1, wherein the one or more inner layers comprises a plurality of reinforcement layers of different materials.

8. The apparatus of claim 1, wherein the at least one metallic layer or at least one layer of ballistic nylon extends continuously along a length of the belt.

9. The apparatus of claim 1, wherein the at least one metallic layer or at least one layer of ballistic nylon extends one or more partial lengths of the belt and is arranged to provide reinforcement at one or more predetermined areas of the belt.

10. The apparatus of claim 1, wherein a thickness or a width of the at least one metallic layer or at least one layer of ballistic nylon varies along a length of the at least one metallic layer or at least one layer of ballistic nylon according to a predetermined pattern, and determines a rigidity or a flexibility of the belt according to the predetermined pattern.

11. The apparatus of claim 1, wherein at least one of the one or more inner layers comprises spring steel or titanium.

12. A holster belt assembly, comprising:

a multi-layered belt comprising a plurality of parallel strips coupled together in an aligned stack, including:

two parallel outer layers with their respective profiles aligned together, including an outside layer and an inside layer; and one or more inner layers sandwiched between the two outer layers and enclosed by the two outer layers, wherein the one or more inner layers includes at least one metallic layer or at least one layer of ballistic nylon;

one or more clip loops coupled to or integral to a surface of at least the inside layer of the belt to couple an implement or an implement holster to the belt, the one or more clip loops comprising lengths of material strips coupled to or integral to the belt along two or more edges of the material strips, which form loops or pockets on the belt; and an implement holster coupled to the belt via the one or more clip loops, using one or more mount devices coupled to the implement holster and inserted into one or more of the clip loops.

13. The holster belt assembly of claim 12, wherein the implement holster is removably coupled to the belt via the one or more clip loops.

14. The holster belt assembly of claim 12, wherein the outside layer of the belt is comprised of a ballistic nylon material and the inside layer is comprised of a neoprene material.

15. The holster belt assembly of claim 12, further comprising one or more accessory pouches removably coupled to the belt.

16. A method, comprising:

providing a multi-layered belt comprised of a plurality of parallel strips coupled together in an aligned stack, including:

two parallel outer layers with their respective profiles aligned together, including an outside layer and an inside layer; and one or more inner layers sandwiched between the two outer layers and enclosed by the two outer layers, wherein the one or more inner layers includes at least one metallic layer or at least one layer of ballistic nylon;

providing a closure portion disposed at a first end of the belt arranged to couple together the first end and a second end of the belt; and providing one or more clip loops coupled to or integral to a surface of at least the inside layer of the belt, the one or more clip loops comprising lengths of material strips coupled to or integral to the belt along two or more edges of the material strips, forming loops or pockets on the belt.

17. The method of claim 16, wherein the one or more inner layers comprises a plurality of reinforcement layers of different materials.

18. The method of claim 16, further comprising providing a security pocket formed within the belt, between the two parallel outer layers, and an opening to access the security pocket through at least one of the two parallel outer layers.

19. The method of claim 16, further comprising providing an adjustment portion disposed at the second end of the belt to interface with the closure portion to determine a retention of the belt when the first end and the second end of the belt are coupled together.

20. The method of claim 16, further comprising providing an implement holster removably coupled to the belt via the one or more clip loops, using one or more mount devices coupled to the implement holster and inserted into one or more of the clip loops.

* * * * *